US006096691A

United States Patent [19]

Conary et al.

[11] Patent Number: 6,096,691

[45] Date of Patent: Aug. 1, 2000

[54] GEAR OIL ADDITIVE CONCENTRATES AND LUBRICANTS CONTAINING THEM

[75] Inventors: Gregory S. Conary, Columbia, Ill.; Rolfe J. Hartley, St. Louis, Mo.

[73] Assignee: Ethyl Corporation, Richmond, Va.

[21] Appl. No.: 08/045,675

[22] Filed: Apr. 9, 1993

[51] Int. Cl.[7] ..... C10M 141/10

[52] U.S. Cl. ..... 508/189; 508/287; 508/322; 508/433; 508/438; 508/567

[58] Field of Search ..... 252/51.5 A, 49.8; 508/189

[56] References Cited

U.S. PATENT DOCUMENTS

| | | | |
|---|---|---|---|
| 3,382,172 | 5/1968 | Lowe | 252/42.7 |
| 4,158,633 | 6/1979 | Papay | 252/32.7 E |
| 5,126,064 | 6/1992 | Barber et al. | 252/51.5 A |
| 5,176,840 | 1/1993 | Campbell et al. | 252/49.6 |
| 5,225,093 | 7/1993 | Campbell et al. | 252/51.5 A |

FOREIGN PATENT DOCUMENTS

| | | |
|---|---|---|
| 020037 | 12/1980 | European Pat. Off. . |
| 1111837 | 5/1968 | United Kingdom . |

OTHER PUBLICATIONS

Smalheer et al, "Lubricant Additives" pp. 1–11, 1967.

*Primary Examiner*—Ellen M. McAvoy
*Attorney, Agent, or Firm*—Dennis H. Rainear; Thomas Hamilton

[57] ABSTRACT

The concentrates comprise specified proportions of diluent oil, an organic sulfur-containing antiwear and/or extreme pressure agent, an ashless dispersant, a dimethyl ester of an aliphatic phosphonic acid in which the aliphatic group has an average in the range of about 12 to about 24 carbon atoms, and a 3-hydrocarbyl-2,5-diketopyrrolidine in which the hydrocarbyl group is an alkyl or alkenyl group having an average in the range of about 12 to about 30 carbon atoms. By using weight ratios of diketopyrrolidine to the dimethyl phosphonate of at least 3:1, the concentrate remains homogeneous at temperatures at least as low as 12° C. When utilized as a top treat in gear oils formulated with conventional GL-4 and GL-5 gear additive packages substantial improvements in limited slip axle performance can be realized.

23 Claims, No Drawings

GEAR OIL ADDITIVE CONCENTRATES AND LUBRICANTS CONTAINING THEM

TECHNICAL FIELD

This invention relates to top treat additive concentrates that possess unforeseen beneficial properties when utilized in gear oils formulated with conventional GL-4 and GL-5 gear additive packages such as are currently available in the marketplace.

TECHNICAL PROBLEM OVERCOME BY THIS INVENTION

U.S. Pat. No. 4,158,6337discloses that dimethyl esters of $C_{12-30}$ aliphatic phosphonic acids are effective friction-reducing additives when formulated for use in crankcase lubricating oil compositions. However, despite their effectiveness as friction-reducing agents these long-chain aliphatic dimethyl phosphonates suffer from a severe shortcoming. When used in additives concentrates or lubricant compositions, precipitate or haze formation readily occurs. While the exact cause of this problem has not been established with absolute certainty, it is believed that trace amounts of water and/or acidic components cause hydrolysis of the phosphonate ester to the corresponding phosphonic acid which has poor solubility in organic media, especially at low temperatures.

Recently a need has arisen for a top treat additive concentrate capable of greatly enhancing the performance capabilities of gear lubricants formulated with present-day commercial GL-4 and GL-5 gear additive packages. When an attempt is made to utilize an effective amount of a dimethyl phosphonate ester of the above patent as the friction reducing component of a top treat additive concentrate containing, inter alia, organic sulfur antiwear and/or extreme pressure additives, rapid haze formation occurs on exposing the concentrate to low temperatures such as are encountered when shipping and storing additive concentrates during winter. Moreover many such concentrates can become unpourable at winter temperatures.

A need exists therefore for an effective way of rendering these phosphonate esters more compatible and/or soluble in such gear oil additive concentrates.

THE INVENTION

It has now been found that the foregoing need can be fulfilled by utilizing in the additive top treat concentrate suitable proportions of a 3-hydrocarbyl-2,5-diketopyrrolidine along with the dimethyl aliphatic phosphonate ester. The diketopyrrolidine serves as a compatibilizing and/or solubilizing agent for the phosphonate ester so that the resultant additive package can be formulated to contain the desired concentrations of the phosphonate friction reducer. Accordingly, this invention thereby provides phosphonate-containing additive concentrates which are homogeneous under ambient room temperature conditions (e.g., 20° C. and above). Moreover, even though the phosphonate may separate out in the concentrate when subjected to relatively low temperatures, the presence of the diketopyrrolidine in the concentrate enables the phosphonate ester to readily redissolve in the concentrate upon application of heat to the concentrate.

The foregoing advantages are thus achieved by employing the diketopyrrolidine and the dimethyl phosphonic acid ester in relative proportions that enable the ester to be dissolved in the concentrate to the desired concentration level and that at the same time provide a top treat additive concentrate that is homogeneous at low temperatures and that has a suitably low pour point. It will be appreciated therefore that the relative proportions will vary to some extent depending upon such factors as the identity of the particular dimethyl phosphonate ester being used, the makeup of the particular gear oil additive concentrate being used, and the identity of the particular diketopyrrolidine being used. Thus in any given situation where the most desirable proportions have not been previously ascertained, all that is required is to run a few simple tests in which the proportions are suitably varied. In this way the appropriate proportions can readily be determined. Generally speaking, however, these components are typically used in proportions such that the weight ratio of the diketopyrrolidine to the phosphonate ester is at least about 3:1, and more preferably at least about 3.5:1, and most preferably at least about 4:1. Normally it is not necessary to use ratios above about 6:1. However, amounts above or below the foregoing ranges can be employed in any situation wherein the desired compatibility and solubility is achieved by doing so.

Accordingly, one embodiment of this invention provides an oil-soluble top treat additive concentrate which comprises:

a) a minor proportion of diluent oil;

b) from 10 to 30% by weight (preferably from 18 to 30% by weight) based on the weight of said concentrate of at least one organic sulfur-containing antiwear and/or extreme pressure agent having a sulfur content of at least about 20% by weight based on the weight of said antiwear and/or extreme pressure agent;

c) from 1 to 5% by weight (preferably from 1.5 to 5% by weight) based on the weight of said concentrate of at least one ashless dispersant;

d) from 2 to 8% by weight (preferably from 3.5 to 7% by weight, and most preferably about 5% by weight) based on the weight of said concentrate of at least one dimethyl ester of an aliphatic phosphonic acid in which the aliphatic group has an average in the range of about 12 to about 24 carbon atoms; and e) from 10 to 30% by weight (preferably from 15 to 25%, and most preferably about 20% by weight) of at least one 3-hydrocarbyl-2,5-diketopyrrolidine in which the hydrocarbyl group is an alkyl or alkenyl group having an average in the range of about 12 to about 30 carbon atoms, the weight ratio of said diketopyrrolidine to said dimethyl ester being at least 3:1 and at least sufficient to render said concentrate homogeneous at temperatures at least as low as 12° C., and preferably at temperatures at least as low as 9° C. More preferably, the components are proportioned such that the concentrate remains homogeneous at temperatures at least down to 6° C.

In a preferred embodiment, the above top treat additive concentrate further comprises at least one of the following additional components:

f) from 0.25 to 5 (and preferably from 0.5 to 2) percent by weight based on the weight of the concentrate of at least one phosphorus-containing antiwear and/or extreme pressure agent;

g) from 1 to 10 (and preferably from 3 to 6) percent by weight based on the weight of the concentrate of at least one copper corrosion inhibitor;

h) from 0.05 to 0.5 (and preferably from 0.1 to 0.3) percent by weight based on the weight of the concentrate of at least one foam inhibitor; and/or i) from 0.05 to 1.0 (and preferably from 0.1 to 0.3) percent by weight based on the weight of the concentrate of at least one antirust agent.

Most preferably, the concentrate contains each of these additional components.

Another embodiment comprises the method of improving the low temperature solubility and compatibility of a dimethyl ester of an aliphatic phosphonic acid in which the aliphatic group has an average in the range of about 12 to about 24 carbon atoms in an additive concentrate that contains at least one organic sulfur antiwear and/or extreme pressure agent and a minor amount of diluent oil, which method comprises blending therewith at least one 3-hydrocarbyl-2,5-diketopyrrolidine in which the hydrocarbyl group is an alkyl or alkenyl group having an average in the range of about 12 to about 30 carbon atoms in an amount such that the weight ratio of said diketopyrrolidine to said dimethyl ester is at least 3:1. Preferably, the aliphatic group of the dimethyl ester has an average in the range of about 16 to about 20 carbon atoms, and the hydrocarbyl group of the diketopyrrolidine is an alkyl or alkenyl group having an average in the range of about 20 to about 24 carbon atoms.

This invention involves the further discovery that lubricant compositions containing the above combination of additive components are exceptionally effective as gear lubricants, especially for use with limited slip axles. In fact in comparative tests as between a typical lubricant of this invention and the same base oil containing the best competitive proprietary premium gear additive package on the market today, the lubricant of this invention outperformed the competitive product by a factor of well over two (8569 miles of trouble-free operation versus 4056 miles for the commercial product which makes claims, inter alia, for good limited slip performance).

Thus another embodiment of this invention is a gear lubricant composition which comprises a major amount of oil of lubricating viscosity containing at least the following components:

b) from 1 to 10% by weight (preferably from 2 to 5% by weight) based on the weight of said lubricant composition of at least one organic sulfur-containing antiwear and/or extreme pressure agent having a sulfur content of at least about 20% by weight based on the weight of said antiwear and/or extreme pressure agent;

c) from 0.2 to 5% by weight (preferably from 0.5 to 3% by weight) based on the weight of said lubricant composition of at least one ashless dispersant;

d) from 0.02 to 1% by weight (preferably from 0.05 to 0.5% by weight, and most preferably about 0. 1% by weight) based on the weight of said lubricant composition of at least one dimethyl ester of an aliphatic phosphonic acid in which the aliphatic group has an average in the range of about 12 to about 24 carbon atoms; and e) from 0.06 to 4% by weight (preferably from 0.15 to 2.0%, and most preferably about 0.4% by weight) based on the weight of said lubricant composition of at least one 3-hydrocarbyl-2,5-diketopyrrolidine in which the hydrocarbyl group is an alkyl or alkenyl group having an average in the range of about 12 to about 30 carbon atoms.

In a preferred embodiment, the above gear lubricant composition further comprises at least one of the following additional components:

f) from 0.1 to 1.0 (and preferably from 0.2 to 0.6) percent by weight based on the weight of the lubricant composition of at least one phosphorus-containing antiwear and/or extreme pressure agent;

g) from 0.1 to 0.8 (and preferably from 0.2 to 0.5) percent by weight based on the weight of the lubricant composition of at least one copper corrosion inhibitor;

h) from 0.01 to 0.1 (and preferably from 0.02 to 0.08) percent by weight based on the weight of the lubricant composition of at least one foam inhibitor; and/or i) from 0.01 to 0.2 (and preferably from 0.02 to 0.1) percent by weight based on the weight of the lubricant composition of at least one an antirust agent.

Most preferably, the lubricant contains each of these additional components.

Component a)

The diluent oil of the present concentrates can be a synthetic oil, a natural oil, a mineral oil, or a blend of such oils. Whatever its composition, the diluent oil should have a viscosity in the range of about 1 to about 3 cSt at 100° C. Use of mineral oils as the diluent of the top treat additive concentrate is preferred. The oil can be paraffinic, naphthenic or a blend of mineral oils. Pursuant to a preferred embodiment, the diluent oil is a 60 Neutral mineral oil.

Component b)

Metal-free sulfur-containing antiwear and/or extreme pressure agents used in the practice of this invention include dihydrocarbyl polysulfides; sulfurized olefins; sulfurized fatty acid esters of both natural and synthetic origins; trithiones; sulfurized thienyl derivatives; sulfurized terpenes; sulfurized polyenes; sulfurized Diels-Alder adducts, etc., provided that the sulfur content of the product is at least about 20 wt %, preferably at least about 30 wt %, and most preferably at least about 40 wt %. Specific examples include sulfurized isobutylene, sulfurized diisobutylene, sulfurized triisobutylene, dicyclohexyl polysulfide, diphenyl polysulfide, dibenzyl polysulfide, dinonyl polysulfide, and mixtures of di-tert-butyl polysulfides such as mixtures of di-tert-butyl trisulfide, di-tert-butyl tetrasulfide and di-tert-butyl pentasulfide, among others. Combinations of different types of metal-free sulfur-containing antiwear and/or extreme pressure agents can also be used, again provided that the combination has an average sulfur content of at least about 20 wt %, preferably at least 30 wt % and most preferably at least 40 wt %. Examples of suitable combinations include combinations of sulfurized isobutylene and di-tert-butyl trisulfide, combinations of sulfurized isobutylene and dinonyl trisulfide, combinations of sulfurized tall oil and dibenzyl polysulfide, and the like. The most preferred oil-soluble metal-free sulfur-containing antiwear and/or extreme pressure agents from the cost-effectiveness standpoint are the sulfurized olefins containing at least about 40% by weight of sulfur, the dihydrocarbyl polysulfides containing at least about 40% by weight of sulfur, and mixtures of such sulfurized olefins and polysulfides. Of these materials, sulfurized isobutylene having a sulfur content of at least 40% by weight and a chlorine content of less than 0.2% by weight is the most especially preferred material. Methods of preparing sulfurized olefins are described in U.S. Pat. Nos. 2,995,569; 3,673,090; 3,703,504; 3,703,505; 3,796,661; and 3,873,454. Also useful are the sulfurized olefin derivatives described in U.S. Pat. No. 4,654,156.

Component c)

The ashless dispersants utilized in the compositions of this invention include carboxylic ashless dispersants, Mannich base dispersants, polymeric polyamine dispersants, and post-treated dispersants of these types. At least some of the ashless dispersant used is preferably a boronated ashless dispersant. These are typically formed by heating the dispersant to a suitable temperature above about 100° C. with a boronating agent. Procedures suitable for effecting boronation of ashless dispersants are described for example in U.S. Pat. Nos. 3,087,936; 3,254,025; 3,281,428; 3,282,955; 2,284,409; 2,284,410; 3,338,832; 3,344,069; 3,533,945; 3,658,836; 3,703,536; 3,718,663; 4,455,243; and 4,652,387.

The carboxylic ashless dispersants are reaction products of an acylating agent (e.g., a monocarboxylic acid, dicarboxylic acid or other polycarboxylic acid, or derivatives thereof) with one or more polyamines and/or polyhydroxy compounds. These products, are described in many patents, including British Patent Specification 1,306,529 and the following U. S. Patents: 3,163,603; 3,184,474; 3,215,707; 3,219,666; 3,271,310; 3,272,746; 3,281,357; 3,306,908; 3,311,558; 3,316,177; 3,340,281; 3,341,542; 3,346,493; 3,381,022; 3,399,141; 3,415,750; 3,433,744; 3,444,170; 3,448,048; 3,448,049; 3,451,933; 3,454,607; 3,467,668; 3,522,179; 3,541,012; 3,542,678; 3,574,101; 3,576,743; 3,630,904; 3,632,510; 3,632,511; 3,697,428; 3,725,441; 3,868,330; 3,948,800; 4,234,435; and U.S. Pat. No. Re 26,433.

There are a number of sub-categories of carboxylic ashless dispersants. One such sub-category which constitutes a preferred type is composed of the polyamine succinamides and more preferably the polyamine succinimides in which the succinic group contains a hydrocarbyl substituent, usually an alkenyl substituent, containing at least 30 carbon atoms. These dispersants are usually formed by reacting a polyamine with an alkenyl succinic acid or anhydride such as a polyisobutenyl succinic acid and anhydride wherein the polyisobutenyl group has a number average molecular weight of 500 to 5,000, preferably 700 to 2,500, and more preferably 700 to 1,400. The polyamine used in forming such compounds contains at least one primary amino group capable of forming an imide group on reaction with a hydrocarbon-substituted succinic acid or acid derivative thereof such an anhydride, lower alkyl ester, acid halide, or acid-ester. The literature is replete with descriptions of polyamines suitable for use in forming such carboxylic ashless dispersants. See for example U.S. Pat. No. 5,034,018 which describes not only simple polyamines but amido-amine adducts which are suitable for use in forming such carboxylic ashless dispersants. Representative examples of such dispersants are given in U.S. Pat. Nos. 3,172,892; 3,202,678; 3,216,936; 3,219,666; 3,254,025; 3,272,746; 4,234,435; and 5,034,018. As used herein the term "succinimide" is meant to encompass the completed reaction product from reaction between the amine reactant(s) and the hydrocarbon-substituted carboxylic acid or anhydride (or like acid derivative) reactant(s), and is intended to encompass compounds wherein the product may have amide, amidine, and/or salt linkages in addition to the imide linkage of the type that results from the reaction of a primary amino group and an anhydride moiety.

Another sub-category of carboxylic ashless dispersants which can be used in the compositions of this invention includes alkenyl succinic acid esters and diesters of alcohols containing 1–20 carbon atoms and 1–6 hydroxyl groups. Representative examples are described in U.S. Pat. Nos. 3,331,776; 3,381,022; and 3,522,179. The alkenyl succinic portion of these esters corresponds to the alkenyl succinic portion of the succinimides described above. Alcohols useful in preparing the esters include methanol, ethanol, 2-methylpropanol, octadecanol, eicosanol, ethylene glycol, diethylene glycol, tetraethylene glycol, diethylene glycol monoethylether, propylene glycol, tripropylene glycol, glycerol, sorbitol, 1,1,1-trimethylol ethane, 1,1,1-trimethylol propane, 1,1,1-trimethylol butane, pentaerythritol, dipentaerythritol, and the like.

The succinic esters are readily made by merely heating a mixture of alkenyl succinic acid, anhydrides or lower alkyl (e.g., $C_1$–$C_4$) ester with the alcohol while distilling out water or lower alkanol. In the case of acid-esters less alcohol is used. In fact, acid-esters made from alkenyl succinic anhydrides do not evolve water. In another method the alkenyl succinic acid or anhydrides can be merely reacted with an appropriate alkylene oxide such as ethylene oxide, propylene oxide, and the like, including mixtures thereof.

Still another sub-category of carboxylic ashless dispersants useful in forming compositions of this invention comprises an alkenyl succinic ester-amide mixture. These may be made by heating the above-described alkenyl succinic acids, anhydrides or lower alkyl esters or etc. with an alcohol and an amine either sequentially or in a mixture. The alcohols and amines described above are also useful in this embodiment. Alternatively, amino alcohols can be used alone or with the alcohol and/or amine to form the ester-amide mixtures. The amino alcohol can contain 1-20 carbon atoms, 1-6 hydroxy groups and 1–4 amine nitrogen atoms. Examples are ethanolamine, diethanolamine, N-ethanol-diethylene triamine, and trimethylol aminomethane. Representative examples of suitable ester-amide mixtures are referred to in U.S. Pat. Nos. 3,184,474; 3,576,743; 3,632,511; 3,804,763; 3,836,471; 3,862,981; 3,936,480; 3,948,800; 3,950,341; 3,957,854; 3,957,855; 3,991,098; 4,071,548; and 4,173,540.

As in the case of the other carboxylic ashless dispersants discussed above, the alkenyl succinic anhydride or like acylating agent is derived from a polyolefin, preferably a polyisobutene, having a number average molecular weight of 500 to 5,000, preferably 700 to 2,500, and more preferably 700 to 1,400. Likewise, residual unsaturation in the polyalkenyl substituent group can be used as a reaction site as for example, by hydrogenation, sulphurization, or the like.

The polymeric polyamine dispersants are polymers containing basic amine groups and oil solubilizing groups (for example, pendant alkyl groups having at least about 8 carbon atoms). Such materials include, but are not limited to, interpolymers of decyl methacrylate, vinyl decyl ether or a relatively high molecular weight olefin with aminoalkyl acrylates and aminoalkyl acrylamides. Examples of polymeric polyamine dispersants are set forth in the following patents: U.S. Pat. Nos. 3,329,658; 3,449,250; 3,493,520; 3,519,565; 3,666,730; 3,687,849; and 3,702,300.

Mannich base dispersants which can be used pursuant to this invention are condensation products formed by condensing a long chain hydrocarbon-substituted phenol with one or more aliphatic aldehydes, usually formaldehyde or a formaldehyde precursor, and one or more polyamines, usually one or more polyalkylene polyamines. Examples of Mannich condensation products, including in many cases boronated Mannich base dispersants, and methods for their production are described in the following U.S. Pat. Nos.: 2,459,112; 2,962,442; 2,984,550; 3,036,003; 3,166,516; 3,236,770; 3,368,972; 3,413,347; 3,442,808; 3,448,047; 3,454,497; 3,459,661; 3,493,520; 3,539,633; 3,558,743; 3,586,629; 3,591,598; 3,600,372; 3,634,515; 3,649,229; 3,697,574; 3,703,536; 3,704,308; 3,725,277; 3,725,480; 3,726,882; 3,736,357; 3,751,365; 3,756,953; 3,793,202; 3,798,165; 3,798,247; 3,803,039; 3,872,019; 3,904,595; 3,957,746; 3,980,569; 3,985,802; 4,006,089; 4,011,380; 4,025,451; 4,058,468; 4,083,699; 4,090,854; 4,354,950; and 4,485,023.

Component d)

Dimethyl esters of aliphatic phosphonic acids in which the aliphatic group has an average in the range of about 12 to about 24 carbon atoms are fully described in U.S. Pat. No. 4,158,633. The aliphatic group can be saturated or unsaturated, and branched or straight chain in structure. Preferred are the dimethyl esters of aliphatic phosphonic acids wherein the aliphatic group has an average in the range of about 16 to about 20 carbon atoms. Most preferred are the phosphonate esters wherein the aliphatic group is relatively pure and contains about 18 carbon atoms or a mixture of phosphonate esters in which the aliphatic groups contain an average of about 18 carbon atoms, such as mixture derived from commercial technical grades of oleyl chloride.

Component e)

The 3-hydrocarbyl-2,5-diketopyrrolidines can be represented by the formula

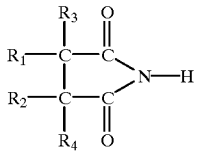

wherein $R_1$ is an alkyl or alkenyl group having an average in the range of about 12 to about 30 carbon atoms (preferably an average in the range of about 20 to about 24 carbon atoms), and each of $R_2$, $R_3$ and $R_4$ is, independently, a hydrogen atom or an alkyl or alkenyl group having an average of up to about 4 carbon atoms. When $R_1$ is an alkenyl group it can contain one olefinic double bond or more than one olefinic double bond. The hydrocarbyl group in the 3-position of the 2,5-diketopyrrolidine can be an alkyl or alkenyl group having one and only one number of carbon atoms, e.g., 18 or 20 carbon atoms, such as is illustrated by (a) essentially pure 3-octadecyl-2,5-diketopyrrolidine or (b) a mixture consisting of 3-octadecyl-2,5-diketopyrrolidines in which the octadecyl group is a mixture of different octadecyl isomers or (c) a mixture consisting of 3-octadecyl-2,5-diketopyrrolidine and 3-octadecenyl-2,5-diketopyrrolidine wherein the octadecyl group is either a single isomer or a mixture of isomeric forms and wherein the octadecenyl group is either a single isomer or a mixture of isomeric forms. Preferably, however, the 3-hydrocarbyl-2,5-diketopyrrolidine is a mixture in which the hydrocarbyl substituent in the 3-position is of different chain lengths such that the average number of carbon atoms in the alkyl and/or alkenyl groups present in the mixture falls in the range of about 12 to about 30 carbon atoms and preferably in the range of about 20 to about 24 carbon atoms. In order to avoid use of cumbersome expressions to avoid unnecessarily distinguishing between having a single number of carbon atoms in the substituent or a plurality of different carbon numbered substituents, the term "average" is used herein. Even if all of the substituent groups have the same number of carbon atoms, that number represents the average number of carbon atoms divided by the number of molecules and thus is an average just as much as, say, 20 represents the average of one $C_{18}$ substituent and one $C_{22}$ substituent.

Compounds of this type an be prepared as described in European Patent Publication No. 20037, published Dec. 10, 1980, which describes their use as friction reducing additives in crank-case lubricating oils and in gasoline and diesel fuel. See also British Patent No. 1,111,837 published May 1, 1968 which suggests their use as ashless dispersants for engine oils and as rust inhibitors in a variety of lubricating oils, including engine oils. The synthesis method described in the European patent publication is deemed superior to that described in the British patent.

As noted above, component e) can be a single compound or a mixture of two or more compounds of the above formula where $R_1$ is an alkyl or alkenyl or polyunsaturated group having an average of about 12 to about 30 carbon atoms or an average of about 12 to about 30 carbon atoms (preferably an average in the range of about 20 to about 24 carbon atoms), and each of $R_2$, $R_3$ and $R_4$ is independently, a hydrogen atom or an alkyl or alkenyl group having an average of up to about 4 carbon atoms. Most preferably each of $R_2$, $R_3$ and $R_4$ is a hydrogen atom. In the most preferred compounds $R_1$ is derived from an isomerized 1-olefin and thus is composed predominantly of at least one group (usually a plurality of groups) represented by the formula $R_5R_6CH$— wherein $R_5$ and $R_6$ are independently alkyl or alkenyl groups, which most preferably are linear or substantially linear. The total number of carbon atoms in R5 and $R_6$ is of course one less than the number of carbon atoms in that particular $R_1$.

An especially preferred 3-hydrocarbyl-2,5-diketopyrrolidine for use as component e) is predominately a mixture of $C_{20}$, $C_{22}$ and $C_{24}$ sec-alkenyl-2,5-diketopyrrolidines made from an isomerized 1-olefin mixture containing (wt %): $C_{18}$, max. 3; $C_{20}$, 45–55; $C_{22}$ 31–47; $C_{24}$ 4–15; and $C_{26}$ max. 1.

Component f)

Typical metal-free phosphorus-containing antiwear and/or extreme pressure additives used in the practice of this invention include esters of phosphorus acids, amine salts of phosphorus acids and phosphorus acid-esters, and partial and total thio analogs of the foregoing. In this connection, for the purposes of this invention an antiwear and/or extreme pressure agent that contains both phosphorus and sulfur in the molecule is deemed a phosphorus-containing antiwear and/or extreme pressure agent. Examples of suitable compounds which may be used as phosphorus-containing antiwear and/or extreme pressure agents include trihydrocarbyl phosphites, phosphonates and phosphates, and dihydrocarbyl phosphites; such as tricresyl phosphate, cresyl diphenyl phosphate, tributyl phosphate, trioleyl phosphate, trilauryl phosphate, tributyl phosphite, trioctyl phosphite, triphenyl phosphite, tricresyl phosphite, tricyclohexyl phosphite, dibutyl lauryl phosphonate, dibutyl hydrogen phosphite, dioleyl hydrogen phosphite, and tolyl phosphinic acid dipropyl ester. Typical sulfur analogs of such compounds are illustrated by tricresyl mono-, di-, tri-, and tetrathiophosphates, tris(decyl) mono-, di-, tri-, and tetrathiophosphates, trinonyl mono-, di-, and trithiophosphites, dioleyl ester of hexadecylthiophosphonic acid, and amyl thiophosphinic acid dimyristyl ester. Among the amine salts which can be employed are amine salts of partially esterified phosphoric, phosphorous, phosphonic, and phosphinic acids and their partial or total thio analogs such as partially esterified monothiophosphoric, dithiophosphoric, trithiophosphoric and tetrathiophosphoric acids; amine salts of phosphonic acids and their thio analogs; and the like. Specific examples include the dihexylammonium salt of dodecylphosphoric acid, the diethyl hexyl ammonium salt of dioctyl dithiophosphoric acid, the octadecylammonium salt of dibutyl thiophosphoric acid, the dilaurylammonium salt of 2-ethylhexylphosphoric acid, the dioleyl ammonium salt of butane phosphonic acid, and analogous compounds.

Among the preferred materials for use as metal-free phosphorus-containing antiwear and/or extreme pressure additives are (i) at least one oil-soluble amine salt of a monohydrocarbyl and/or dihydrocarbyl ester of a phosphoric or thiophosphoric acid, such acid having the formula $$(HX^1)(HX^2)(HX^3)PX^4$$

wherein each of $X^1$, $X^2$, $X^3$ and $X^4$ is, independently, an oxygen atom or a sulphur atom, and most preferably wherein at least three of them are oxygen atoms; (ii) at least one oil-soluble phosphorus- and nitrogen-containing composition formed by reacting a hydroxy-substituted triester of a phosphorothioic acid with an inorganic phosphorus acid, phosphorus oxide or phosphorus halide to produce an acidic intermediate, and neutralizing a substantial portion of said acidic intermediate with at least one amine or hydroxy amine; (iii) at least one oil-soluble amine salt of a hydroxy-substituted phosphetane or a hydroxy-thiophosphetane (sometimes referred to as "phosphetans" or "thiophosphetans"); or a combination of any two or all three of (i), (ii) and (iii). The phosphorus- and nitrogen-containing compositions of type (ii) are described in G.B. 1,009,913; G.B. 1,009,914; U.S. Pat. No. 3,197,405 and/or U.S. Pat. No. 3,197,496.

In general, these compositions are formed by forming an acidic intermediate by the reaction of a hydroxy-substituted triester of a phosphorothioic acid with an inorganic phosphorus acid, phosphorus oxide or phosphorus halide, and neutralizing a substantial portion of said acidic intermediate with an amine or hydroxy-substituted amine. The type (iii) phosphorus- and nitrogen-containing antiwear and/or extreme pressure additives which can be used in the compositions of this invention are the amine salts of hydroxy-substituted phosphetanes or the amine salts of hydroxy-substituted thiophosphetanes. Typically, such salts are derived from compounds of the formula

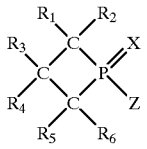

wherein each of $R_1$, $R_{21}$ $R_3$, $R_4$, R5 and $R_6$ is a hydrogen atom or a carbon-bonded organic group such as a hydrocarbyl group or a substituted hydrocarbyl group wherein the substituent(s) do(es) not materially detract from the predominantly hydrocarbonaceous character of the hydrocarbyl group; X is a sulphur or an oxygen atom and Z is a hydroxyl group or an organic group having one or more acidic hydroxyl groups. Examples of this general type of antiwear and/or extreme pressure agent include the amine salts hydroxyphosphetanes and the amine salts of hydroxy-thiophosphetanes.

Component g)

One type of copper corrosion inhibitors which can be used in the practice of this invention is comprised of thiazoles, triazoles and thiadiazoles. Examples include benzotriazole, tolyltriazole, octyltriazole, decyltriazole, dodecyltriazole, 2-mercap-tobenzothiazole, 2,5-dimercapto-1,3,4-thiadiazole, 2-mercapto-5-hydrocarbylthio-1,3,4-thiadiazoles,2-mercapto-5-hydrocarbyldithio-1,3,4-thiadiazoles,2,5-bis(hydrocarbylthio)-1,3,4-thiadiazoles, and 2,5-bis(hydrocarbyldithio)-1,3,4-thiadiazoles. The preferred compounds are the 1,3,4-thiadiazoles, especially the 2-hydrocarbyldithio-5-mercapto-1,3,4-dithiadiazoles and the2,5-bis(hydrocarbyldithio)- 1,3,4-thiadiazoles, a number of which are available as articles of commerce. Other suitable inhibitors of copper corrosion include ether amines; polyethoxylated compounds such as ethoxylated amines, ethoxylated phenols, and ethoxylated alcohols; imidazolines; and the like.

Component h)

Suitable antifoam agents for use in the compositions of this invention include silicones and organic polymers such as acrylate polymers. Various antifoam agents are described in Foam Control Agents by H. T. Kerner (Noyes Data Corporation, 1976, pages 125–176). Mixtures of silicone-type antifoam agents such as the liquid dialkyl silicone polymers with various other substances are also effective. Typical of such mixtures are silicones mixed with an acrylate polymer, silicones mixed with one or more amines, and silicones mixed with one or more amine carboxylates. Other such mixtures include combinations of a dimethyl silicone oil with (i) a partial fatty acid ester of a polyhydric alcohol (U.S. Pat. No. 3,235,498); (ii) an alkoxylated partial fatty acid ester of a polyhydric alcohol (U.S. Pat. No. 3,235,499); (iii) a polyalkoxylated aliphatic amine (U.S. Pat. No. 3,235,501); and (iv) an alkoxylated aliphatic acid (U.S. Pat. No. 3,235,502).

Component i)

The compositions of this invention preferably also contain a rust inhibitor. This may be a single compound or a mixture of compounds having the property of inhibiting corrosion of ferrous metal surfaces. Such materials include oil-soluble monocarboxylic acids such as 2-ethylhexanoic acid, lauric acid, myristic acid, palmitic acid, oleic acid, linoleic acid, linolenic acid, behenic acid, cerotic acid, etc., and oil-soluble polycarboxylic acids including dimer and trimer acids, such as are produced from tall oil fatty acids, oleic acid, linoleic acid, or the like. Other suitable corrosion inhibitors include alkenylsuccinic acids in which the alkenyl group contains 10 or more carbon atoms such as, for example, tetrapropenylsuccinic acid, tetradecenylsuccinic acid, hexadecenylsuccinic acid, and the like; long-chain $\alpha,\omega$-dicarboxylic acids in the molecular weight range of 600 to 3000; and other similar materials. Products of this type are currently available from various commercial sources, such as, for example, the dimer and trimer acids sold under the HYSTRENE trademark by the Humco Chemical Division of Witco Chemical Corporation and under the EMPOL trademark by Emery Chemicals. Another useful type of acidic corrosion inhibitors are the half esters of alkenyl succinic acids having 8 to 24 carbon atoms in the alkenyl group with alcohols such as the polyglycols. The corresponding half amides of such alkenyl succinic acids are also useful. Although added in acidic form, some or all of the carboxylic groups of these carboxylic acid type corrosion inhibitors may be neutralized by excess amine present in the compositions. Other suitable corrosion inhibitors include ether amines; acid phosphates; amines; polyethoxylated compounds such as ethoxylated amines, ethoxylated phenols, ethoxylated alcohols; imidazolines; and aminosuccinic acids or derivatives thereof represented by the formula:

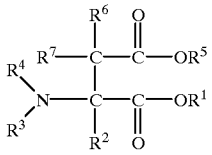

wherein each of $R^1$, $R^2$, $R^5$, $R^6$ and $R^7$ is, independently, a hydrogen atom or a hydrocarbyl group containing 1 to 30 carbon atoms, and wherein each of $R^3$ and $R^4$ is, independently, a hydrogen atom, a hydrocarbyl group containing 1 to 30 carbon atoms, or an acyl group containing from 1 to 30 carbon atoms. The groups $R^1$, $R^2$, $R^3$, $R^4$, $R^5$, $R^6$ and $R^7$, when in the form of hydrocarbyl groups, can be, for example, alkyl, cycloalkyl or aromatic containing groups. Preferably $R^1$ and $R^5$ are the same or different straight-chain or branched-chain hydrocarbon radicals containing up to 20 carbon atoms. Most preferably, $R^1$ and $R^5$ are saturated hydrocarbon radicals containing 3–6 carbon atoms. $R^2$, either $R^3$ or $R^4$, $R^6$ and $R^7$, when in the form of hydrocarbyl groups, are preferably the same or different straight-chain or branched-chain saturated hydrocarbon radicals. Preferably a dialkyl ester of an aminosuccinic acid is used in which $R^1$ and $R^5$ are the same or different alkyl groups containing 3–6 carbon atoms, $R^2$ is a hydrogen atom, and either $R^3$ or $R^4$ is an alkyl group containing 15–20 carbon atoms or an acyl group which is derived from a saturated or unsaturated carboxylic acid containing 2–10 carbon atoms. Most preferred of the aminosuccinic acid derivatives is a dialkylester of an aminosuccinic acid of the above formula wherein $R^1$ and $R^5$ are isobutyl, $R^2$ is a hydrogen atom, $R^3$ is octadecyl and/or octadecenyl and $R^4$ is 3-carboxy-1-oxo-2-propenyl. In such ester $R^6$ and $R^7$ are most preferably hydrogen atoms.

Components f), g), h) and i) above are optional components. However, it is preferred to employ at least one of them, and most preferably, all of them.

The base oils can be hydrocarbon oils of lubricating viscosity derived from petroleum (or tar sands, coal, shale, etc.). Likewise, the base oils can be natural oils of suitable viscosities such as rapeseed oil, etc., and synthetic oils such as hydrogenated polyolefin oils; poly-α-olefins (e.g., hydrogenated or unhydrogenated α-olefin oligomers such as hydrogenated poly-1-decene); alkyl esters of dicarboxylic acids; complex esters of dicarboxylic acid, polyglycol and alcohol; alkyl esters of carbonic or phosphoric acids; polysilicones; fluorohydrocarbon oils; and mixtures of mineral, natural and/or synthetic oils in any proportion, etc. The term "base oil" for this disclosure includes all the foregoing. The fact that the base oils used in the compositions of this invention may be composed of (i) one or more mineral oils, (ii) one or more synthetic oils, (iii) one or more natural oils, or (iv) a blend of (i) and (ii), or (i) and (iii), or (ii) and (iii), or (i), (ii) and (iii) does not mean that these various types of oils are necessarily equivalents of each other. Certain types of base oils may be used for the specific properties they possess such as biodegradability, high temperature stability, or non-flammability. In other compositions, other types of base oils may be preferred for reasons of availability or low cost. Thus, the skilled artisan will recognize that while the various types of base oils discussed above may be used in the compositions of this invention, they are not necessarily equivalents of each other in every instance.

The following examples illustrate the practice of this invention. These examples are not intended to limit, do not limit, and should not be construed as limiting the generic aspects of this invention in any manner whatsoever. In these examples all parts and percentages are by weight.

EXAMPLE 1

A top treat additive concentrate of this invention is formulated to contain: 24.4% of sulfurized isobutylene; 3.18% of a 70% mineral oil solution of boronated polyethylene polyamine polyisobutenyl succinimide ashless dispersant having a boron content of 1.3% and a nitrogen content of 1.4%; 5.81% of 2-alkyldithio-5-mercapto-1,3,5-thiadiazole and 2,5-di(alkyldithio)-1,3, 5-thiadiazole copper corrosion inhibitor; 5% of dimethyl oleyl phosphonate; 20% of 3-hydrocarbyl-2,5-diketopyrrolidine in which the hydrocarbyl group is predominately a mixture of $C_{20}$, $C_{22}$ and $C_{24}$ sec-alkenyl-2,5-diketopyrrolidines made from an isomerized 1-olefin mixture containing (wt %): $C_{18}$, max. 3; $C_{20}$, 45–55; $C_{22}$ 31–47; $C_{24}$ 4–15; and $C_{26}$ max. 1; 36.75% of 60 Neutral mineral oil; and 4.87% of 100 Neutral mineral oil.

EXAMPLE 2

A top treat is formulated as in Example 1 except that the content of 60 Neutral mineral oil is reduced to 30.0% and the concentrate additionally contains a sulfur-phosphorus antiwear and/or extreme pressure system and an amine carboxylate antirust system formed by interactions among a portion of the 24.4% of sulfurized isobutylene, 1.19% of dibutyl hydrogen phosphite, 1.68% of aliphatic primary monoamines, 0.2% of aliphatic carboxylic acids, and 0.25% of monoalkyl and dialkyl acid phosphates; 3.33% of trihydrocarbyl dithiophosphate; and 0.15% of foam inhibitor. The resultant top treat additive concentrate has a pour point of 6° C.

EXAMPLE 3

A top treat is formed as in Example 1 except that the 24.4% of sulfurized isobutylene is replaced by 24.4% of a combination of 60% sulfurized isobutylene and 40% dialkyl polysulfide.

EXAMPLE 4

A top treat is formed as in Example 2 except that the dialkyl hydrogen phosphite, the primary aliphatic monoamines, the mono- and dialkyl acid phosphates and the trihydrocarbyl dithiophosphate are replaced by an equivalent amount of phosphorus as a product made by the following procedure: 53 parts of phosphorus pentoxide is added to 430 parts of hydroxypropyl-0,0'-di(4-methyl-2-pentyl)phosphorodithioic acid at 60–63° C. within a period of 5.5 hours. The reaction mixture is heated to 75–80° C. and held at this temperature for 2 hours. To this reaction mixture is added over a period of 1.5 hours 219 parts of a mixture of tertiary alkyl primary monoamines having 11 to 14 carbon atoms while controlling the temperature to 30–60° C. Then the product mixture is maintained at 50–60° C. for 0.5 hour and filtered. The resultant product should have a phosphorus content of about 8%, a sulfur content of about 10.4% and a nitrogen content of about 2.2%.

EXAMPLE 5

A top treat is formed as in Example 2 except that (i) the sulfurized isobutylene is replaced by an equivalent amount of sulfur as a diisobutene polysulfide containing an average of 3.2 sulfur atoms per molecule prepared by stepwise reaction of isobutene with sulfur monochloride and sodium sulfide, and (ii) the dialkyl hydrogen phosphite, the primary aliphatic monoamines, the mono- and dialkyl acid phosphates and the trihydrocarbyl dithiophosphate are replaced by an equivalent amount of phosphorus as a product made by the procedure described in Example 4.

EXAMPLE 6

A finished gear oil lubricant is formed by blending 2% by weight of the top treat of Example 1 with 98% by weight of a 80 W–90 mineral oil containing 6.5% of HiTEC® 2375 gear oil additive. The resultant lubricant is a composition of this invention.

EXAMPLE 7

A finished gear oil lubricant is formed by blending 2% by weight of the top treat of Example 2 with 98% by weight of a 80 W–90 mineral oil containing 6.5% of HiTEC® 2375 gear oil additive. The resultant lubricant is a composition of this invention.

EXAMPLE 8

A finished gear oil lubricant is formed by blending 2% by weight of the top treat of Example 2 with 98% by weight of a 80 W–90 mineral oil containing 7.0% of Anglamol® 9000 gear oil additive. The resultant lubricant is a composition of this invention.

EXAMPLE 9

A finished gear oil lubricant is formed by blending 2% by weight of the top treat of Example 2 with 98% by weight of a 80 W–90 mineral oil containing 7.0% of Anglamol® 9001 gear oil additive. The resultant lubricant is a composition of this invention.

EXAMPLE 10

A finished gear oil lubricant is formed by blending 2% by weight of the top treat of Example 2 with 98% by weight of a 80 W–90 mineral oil containing 6.5% of Mobilad® G521T gear oil additive. The resultant lubricant is a composition of this invention.

EXAMPLE 11

A finished gear oil lubricant is formed by blending 2% by weight of the top treat of Example 2 with 98% by weight of a 80 W–90 mineral oil containing 8% of Anglamol® 6043U gear oil additive. The resultant lubricant is a composition of this invention.

EXAMPLE 12

A finished gear oil lubricant is formed by blending 2% by weight of the top treat of Example 2 with 98% by weight of a 80 W–90 mineral oil containing 10% of Chevron OLOA 9750 gear oil additive. The resultant lubricant is a composition of this invention.

The remarkable effectiveness of this invention was demonstrated by comparative tests wherein the composition of Example 7 was compared with another portion of the same mineral base oil containing 7.0 wt. % of the best competitive proprietary premium gear additive package on the market today, a product for which claims are made by the manufacturer, inter alia, for good limited slip performance. Both lubricants were run under the same test conditions using the Big Wheel/Little Wheel test, originally developed by General Motors. The lubricant of this invention ran 8569 miles before failure due to chattering. In contrast, the commercial additive ran only 4056 miles until failure was experienced due to chattering.

The importance of the weight ratio of the diketopyrrolidine to the phosphonate ester was demonstrated in comparative experiments in which identical compositions containing 25 weight percent of the combination of these two identical components were subjected to storage for 24 hours at 4.40° C. (40° F.). In one case pursuant to this invention, the components were utilized in a weight ratio of 4:1 respectively. In the comparative run, not of this invention, the components were utilized in a weight ratio of 1.5:1. The composition of this invention remained fully compatible throughout the 24 hour storage period—no evidence of haze or precipitate formation was observed. In contrast, the comparative composition not of this invention became solid during the 24 hour test period.

As used herein the term "oil-soluble" means that the material under discussion can be dissolved in or be stably dispersed in the base oil of this invention to at least the minimum concentration required for use as described herein. Preferably, the material has a solubility or dispersibility in the base oil well in excess of such minimum concentration. However the term does not signify that the material must dissolve or be dispersible in all proportions in the base oil.

In all cases, numerical ranges given herein, if not qualified, are susceptible to latitude as if qualified by the term "about" or "approximately". Thus this disclosure and the ensuing claims are to be interpreted with this caveat in mind.

Some additive components are supplied in the form of solutions of the active ingredient(s) in an inert diluent or solvent, such as a diluent oil. For example, ashless dispersants are usually provided in the form of such solutions. Unless expressly stated to the contrary, the amounts and concentrations of each additive component are expressed in terms of active additive—i.e., the amount of solvent or diluent that may be associated with such component as received is excluded.

The disclosures of each patent or patent publication cited in the foregoing disclosure is incorporated herein by reference as if fully set forth herein.

This invention is susceptible to considerable variation within the spirit and scope of the appended claims. Accordingly, this invention is not intended to be limited by the specific exemplifications set forth herein.

We claim:

1. A homogeneous, oil-soluble additive concentrate which comprises:

a) a minor proportion of diluent oil;

b) from 10 to 30% by weight based on the weight of said concentrate of an organic sulfur-containing antiwear and/or extreme pressure agent having a sulfur content of at least about 20% by weight based on the weight of said antiwear and/or extreme pressure agent;

c) from 1 to 5% by weight based on the weight of said concentrate of an ashless dispersant;

d) from 2 to 8% by weight based on the weight of said concentrate of a dimethyl ester of an aliphatic phosphonic acid in which the aliphatic group has an average in the range of about 12 to about 24 carbon atoms;

e) from 10 to 30% by weight of a 3-hydrocarbyl-2,5-diketopyrrolidine in which the hydrocarbyl group is an alkyl or alkenyl group having an average in the range of about 12 to about 30 carbon atoms, the weight ratio of said diketopyrrolidine to said dimethyl ester being at least 3:1 and at least sufficient to render said concentrate homogeneous at temperatures at least as low as 12° C.

2. An additive concentrate in accordance with claim 1 wherein said organic sulfur-containing antiwear and/or extreme pressure agent is a sulfurized olefin, and said ashless dispersant is a borated ashless dispersant.

3. An additive concentrate in accordance with claim 1 wherein said organic sulfur-containing antiwear and/or extreme pressure agent is sulfurized isobutylene having a sulfur content in the range of 40 to 50% by weight based on the weight of said sulfurized isobutylene, and said ashless dispersant is a borated ashless dispersant.

4. An additive concentrate in accordance with claim 1 wherein the aliphatic group of said dimethyl ester has an average in the range of about 16 to about 20 carbon atoms, and the hydrocarbyl group of said diketopyrrolidine is an alkyl or alkenyl group having an average in the range of about 20 to about 24 carbon atoms.

5. An additive concentrate in accordance with claim 1 wherein said organic sulfur-containing antiwear and/or extreme pressure agent is sulfurized isobutylene having a sulfur content in the range of 40 to 50% by weight based on the weight of said sulfurized isobutylene, wherein said ashless dispersant is a borated succinimide or succinic ester-amide ashless dispersant, wherein the aliphatic group of said dimethyl ester has an average in the range of about 16 to about 20 carbon atoms, and wherein the hydrocarbyl group of said ditetopyrrolidine is an alkyl or alkenyl group having an average in the range of about 20 to about 24 carbon atoms.

6. An additive concentrate in accordance with claim 1 further comprising at least one of the following additional components:

f) from 0.25 to 5 percent by weight based on the weight of the concentrate of at least one phosphorus-containing antiwear and/or extreme pressure agent;

g) from 1 to 10 percent by weight based on the weight of the concentrate of at least one copper corrosion inhibitor;

h) from 0.05 to 0.5 percent by weight based on the weight of the concentrate of at least one foam inhibitor; and i) from 0.05 to 1 percent by weight based on the weight of the concentrate of at least one an antirust agent.

7. A composition in accordance with claim 1 wherein said additive concentrate contains from 18 to 30 percent by weight of said component b) based on the weight of said concentrate, from 1.5 to 5 percent by weight of said component c) based on the weight of said concentrate, from 3.5 to 7% by weight of said component d) based on the weight of said concentrate, and from 15 to 25 percent by weight of said component e) based on the weight of said concentrate.

8. An additive concentrate in accordance with claim 7 further comprising each of the following additional components:

f) from 0.5 to 2 percent by weight based on the weight of the concentrate of at least one phosphorus-containing antiwear and/or extreme pressure agent;

g) from 3 to 6 percent by weight based on the weight of the concentrate of at least one copper corrosion inhibitor;

h) from 0.1 to 0.3 percent by weight based on the weight of the concentrate of at least one foam inhibitor; and i) from 0.1 to 0.3 percent by weight based on the weight of the concentrate of at least one an antirust agent.

9. An additive concentrate in accordance with claim 8 wherein said diluent oil consists essentially of 60 Neutral mineral oil.

10. An additive concentrate in accordance with claim 8 wherein said organic sulfur-containing antiwear and/or extreme pressure agent comprises a sulfurized olefin, and said ashless dispersant comprises a borated ashless dispersant.

11. An additive concentrate in accordance with claim 8 wherein said organic sulfur-containing antiwear and/or extreme pressure agent comprises sulfurized isobutylene having a sulfur content in the range of 40 to 50% by weight based on the weight of said sulfurized isobutylene, and said ashless dispersant comprises a borated ashless dispersant.

12. An additive concentrate in accordance with claim 8 wherein the aliphatic group of said dimethyl ester has an average in the range of about 16 to about 20 carbon atoms, and the hydrocarbyl group of said diketopyrrolidine is an alkyl or alkenyl group having an average in the range of about 20 to about 24 carbon atoms.

13. An additive concentrate in accordance with claim 8 wherein said organic sulfur-containing antiwear and/or extreme pressure agent is sulfurized isobutylene having a sulfur content in the range of 40 to 50% by weight based on the weight of said sulfurized isobutylene, wherein said ashless dispersant is a borated succinimide or succinic ester-amide ashless dispersant, wherein the aliphatic group of said dimethyl ester has an average in the range of about 16 to about 20 carbon atoms, and wherein the hydrocarbyl group of said diketopyrrolidine is an alkyl or alkenyl group having an average in the range of about 20 to about 24 carbon atoms.

14. A gear lubricant composition which comprises a major amount of oil of lubricating viscosity containing at least the following components:

b) from 1 to 10% by weight based on the weight of said lubricant composition of at least one organic sulfur-containing antiwear and/or extreme pressure agent having a sulfur content of at least about 20% by weight based on the weight of said antiwear and/or extreme pressure agent;

c) from 0.2 to 5% by weight based on the weight of said lubricant composition of at least one ashless dispersant;

d) from 0.02 to 1% by weight based on the weight of said lubricant composition of at least one dimethyl ester of an aliphatic phosphonic acid in which the aliphatic group has an average in the range of about 12 to about 24 carbon atoms; and e) from 0.06 to 4% by weight based on the weight of said lubricant composition of at least one 3-hydrocarbyl-2, 5-diketopyrrolidine in which the hydrocarbyl group is an alkyl or alkenyl group having an average in the range of about 12 to about 30 carbon atoms, the weight ratio of said diketopyrrolidine to said dimethyl ester being at least 3:1.

15. A gear lubricant composition in accordance with claim 14 further comprising at least one of the following additional components:

f) from 0.1 to 1 percent by weight based on the weight of the lubricant composition of at least one phosphorus-containing antiwear and/or extreme pressure agent;

g) from 0.1 to 0.8 percent by weight based on the weight of the lubricant composition of at least one copper corrosion inhibitor;

h) from 0.01 to 0.1 percent by weight based on the weight of the lubricant composition of at least one foam inhibitor; and i) from 0.01 to 0.2 percent by weight based on the weight of the lubricant composition of at least one an antirust agent.

16. A gear lubricant composition in accordance with claim 14 wherein said composition contains from 2 to 5 percent by weight of said component b) based on the weight of said composition, from 0.5 to 3 percent by weight of said component c) based on the weight of said composition, from 0.05 to 0.5 percent by weight of said component d) based on the weight of said composition, and from 0.15 to 2 percent by weight of said component e) based on the weight of said composition.

17. A gear lubricant composition in accordance with claim 16 further comprising at least one of the following additional components:

f) from 0.2 to 0.6 percent by weight based on the weight of the lubricant composition of at least one phosphorus-containing antiwear and/or extreme pressure agent;

g) from 0.2 to 0.5 percent by weight based on the weight of the lubricant composition of at least one copper corrosion inhibitor;

h) from 0.02 to 0.08 percent by weight based on the weight of the lubricant composition of at least one foam inhibitor; and i) from 0.02 to 0.1 percent by weight based on the weight of the lubricant composition of at least one an antirust agent.

18. A gear lubricant composition in accordance with claim 14 wherein said organic sulfur-containing antiwear and/or extreme pressure agent comprises a sulfurized olefin, and said ashless dispersant comprises a borated ashless dispersant.

19. A gear lubricant composition in accordance with claim 18 wherein the aliphatic group of said dimethyl ester has an average in the range of about 16 to about 20 carbon atoms, and the hydrocarbyl group of said diketopyrrolidine is an alkyl or alkenyl group having an average in the range of about 20 to about 24 carbon atoms.

20. A gear lubricant composition in accordance with claim 15 wherein said organic sulfur-containing antiwear and/or extreme pressure agent comprises a sulfurized olefin, and said ashless dispersant comprises a borated ashless dispersant.

21. A gear lubricant composition in accordance with claim 20 wherein the aliphatic group of said dimethyl ester has an average in the range of about 16 to about 20 carbon atoms, and the hydrocarbyl group of said diketopyrrolidine is an alkyl or alkenyl group having an average in the range of about 20 to about 24 carbon atoms.

22. The method of improving the low temperature solubility and compatibility of a dimethyl ester of an aliphatic phosphonic acid in which the aliphatic group has an average in the range of about 12 to about 24 carbon atoms in an additive concentrate that contains at least one organic sulfur antiwear and/or extreme pressure agent and a minor amount of diluent oil, which method comprises blending therewith at least one 3-hydrocarbyl-2,5-diketopyrrolidine in which the hydrocarbyl group is an alkyl or alkenyl group having an average in the range of about 12 to about 30 carbon atoms in an amount such that the weight ratio of said diketopyrrolidine to said dimethyl ester is at least 3:1.

23. The method of claim 22 wherein the aliphatic group of said dimethyl ester has an average in the range of about 16 to about 20 carbon atoms, and the hydrocarbyl group of said diketopyrrolidine is an alkyl or alkenyl group having an average in the range of about 20 to about 24 carbon atoms.

* * * * *